US009909377B2

(12) United States Patent
Finkenzeller et al.

(10) Patent No.: US 9,909,377 B2
(45) Date of Patent: Mar. 6, 2018

(54) UNDERWATER DRILLING DEVICE AND METHOD FOR PROCURING AND ANALYZING GROUND SAMPLES OF A BED OF A BODY OF WATER

(71) Applicants: BAUER Maschinen GmbH, Schrobenhausen (DE); Universitaet Bremen, Bremen (DE)

(72) Inventors: Stefan Michael Finkenzeller, Reichertshofen (DE); Leonhard Weixler, Thierhaupten (DE); Tim Freudenthal, Ottersberg (DE)

(73) Assignees: BAUER Maschinen GmbH, Schrobenhausen (DE); Universitaet Bremen, Bremen (DE)

( * ) Notice: Subject to any disclaimer, the term of this patent is extended or adjusted under 35 U.S.C. 154(b) by 0 days.

(21) Appl. No.: 15/309,912

(22) PCT Filed: May 13, 2014

(86) PCT No.: PCT/EP2014/059760
§ 371 (c)(1),
(2) Date: Nov. 9, 2016

(87) PCT Pub. No.: WO2015/172818
PCT Pub. Date: Nov. 19, 2015

(65) Prior Publication Data

US 2017/0152719 A1 Jun. 1, 2017

(51) Int. Cl.
*E21B 7/124* (2006.01)
*E21B 25/18* (2006.01)
(Continued)

(52) U.S. Cl.
CPC ..... *E21B 25/18* (2013.01); *E21B 7/124* (2013.01); *E21B 19/143* (2013.01); *E21B 25/10* (2013.01);
(Continued)

(58) Field of Classification Search
CPC ..... E21B 7/124; E21B 25/10; E21B 25/18; E21B 47/12; E21B 49/001; E21B 49/025
See application file for complete search history.

(56) References Cited

U.S. PATENT DOCUMENTS 4,043,404 A 8/1977 Sorlie et al.
6,394,192 B1 * 5/2002 Frazer ..... E21B 7/124 175/20
(Continued)

FOREIGN PATENT DOCUMENTS

DE 695 01 539 T2 6/1998
EP 2860341 A1 * 4/2015 ..... E21B 7/124
(Continued)

OTHER PUBLICATIONS

International Search Report issued in PCT/EP2014/059760, dated Feb. 16, 2015.
(Continued)

*Primary Examiner* — Matthew R Buck
(74) *Attorney, Agent, or Firm* — Studebaker & Brackett PC

(57) ABSTRACT

The invention relates to underwater drilling for procuring and analyzing ground samples of a bed of a body of water. An underwater drilling device placed onto a bed of the body of water. By a drill drive a drill rod composed of at least one tubular drill rod element is drilled into the bed of the body of water in a first drilling step, wherein a drill core is received in a receiving part in the tubular drill rod element. The receiving part with the drill core is deposited in a
(Continued)

Figure 1:
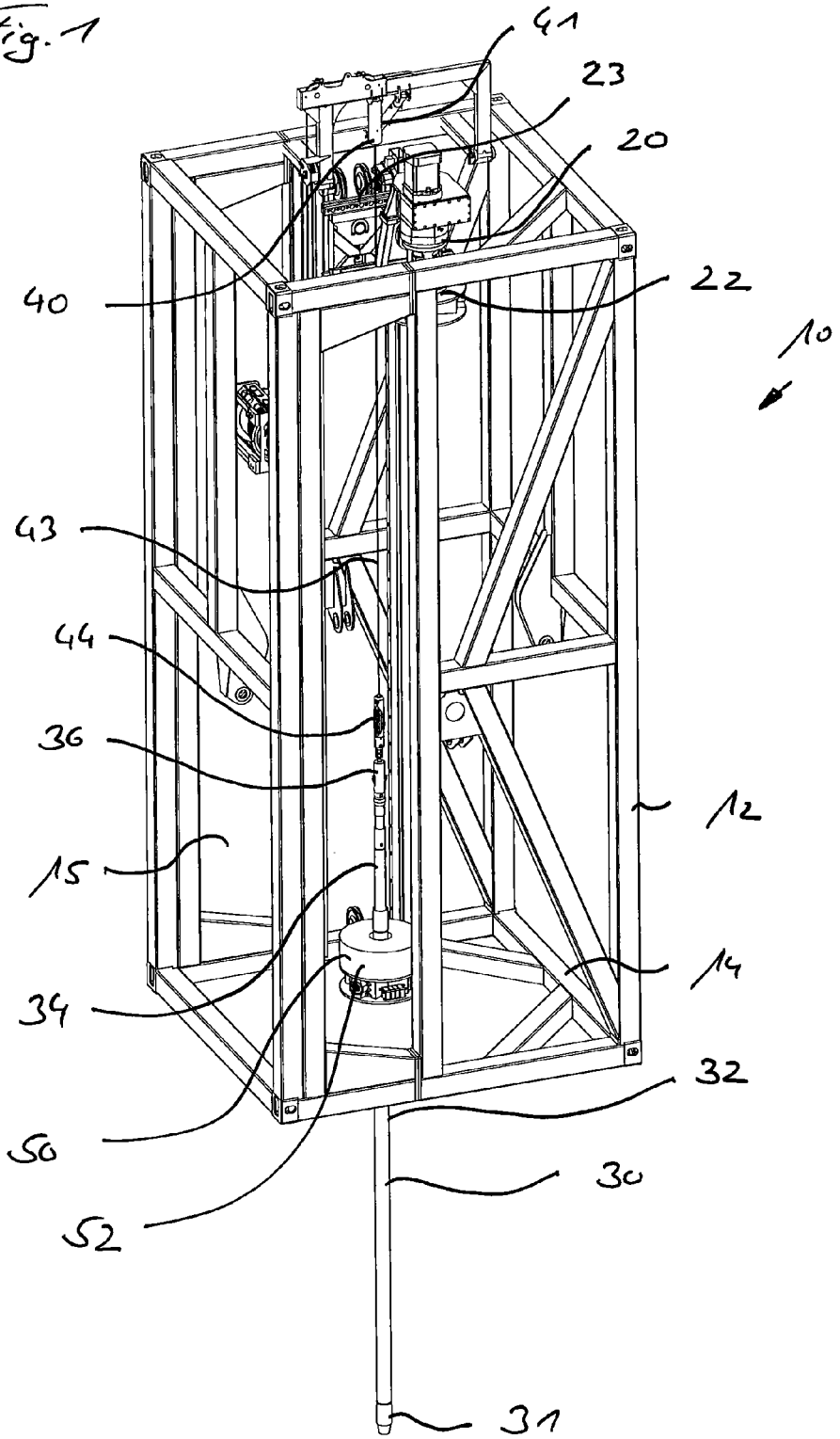

storage place of a storage area on the base frame. Subsequently, one further drilling step is carried out with a further drill rod element. By means of sensor means at least one physical and/or chemical property of the drill core is determined. data on the storage place of the drill core in the second storage area.

10 Claims, 3 Drawing Sheets

(51) Int. Cl.

| | |
|---|---|
| ***E21B 41/00*** | (2006.01) |
| ***E21B 49/02*** | (2006.01) |
| ***E21B 19/14*** | (2006.01) |
| ***E21B 25/10*** | (2006.01) |
| ***E21B 47/12*** | (2012.01) |

(52) U.S. Cl.
CPC ..... *E21B 41/0007* (2013.01); *E21B 47/12* (2013.01); *E21B 49/025* (2013.01)

(56) References Cited

U.S. PATENT DOCUMENTS

| | | | | |
|---|---|---|---|---|
| 6,526,818 | B1 * | 3/2003 | Head | E21B 7/128 175/50 |
| 7,380,614 | B1 | 6/2008 | Williamson et al. | |
| 8,272,457 | B2 * | 9/2012 | Pardey | E21B 25/02 166/240 |
| 9,322,220 | B2 * | 4/2016 | Innes | E21B 7/124 |
| 2009/0178847 | A1 * | 7/2009 | Nellessen, Jr. | E21B 7/12 175/5 |
| 2015/0176404 | A1 * | 6/2015 | Smith | G01N 23/222 73/152.11 |

FOREIGN PATENT DOCUMENTS

| | | | | |
|---|---|---|---|---|
| GB | 2094852 | A * | 9/1982 | B63C 11/52 |
| JP | H07-120411 | A | 5/1995 | |
| JP | H09-243607 | A | 9/1997 | |
| JP | 2003-014867 | A | 1/2003 | |
| JP | 2007-005514 | A | 1/2007 | |
| WO | 95/33123 | A1 | 12/1995 | |
| WO | 2012/000077 | A1 | 1/2012 | |
| WO | 2013/188903 | A1 | 12/2013 | |
| WO | 2014/015362 | A1 | 1/2014 | |

OTHER PUBLICATIONS

An Office Action issued by the Canadian Intellectual Property Office on Sep. 6, 2017, which corresponds to Canadian Patent Application No. 2,944,062 and is related to U.S. Appl. No. 15/309,912.

An Office Action; "Notice of Reasons for Rejection" issued by the Japanese Patent Office dated Nov. 14, 2017, which corresponds to Japanese Patent Application No. 2016-562941 and is related to U.S. Appl. No. 15/309,912; with English language Concise Explanation.

* cited by examiner

UNDERWATER DRILLING DEVICE AND METHOD FOR PROCURING AND ANALYZING GROUND SAMPLES OF A BED OF A BODY OF WATER

The invention relates to an underwater drilling device for procuring and analyzing ground samples of a bed of a body of water, having a base frame which is designed for lowering into a body of water and for placing onto the bed of the body of water, a drill drive for rotationally driving a drill rod which is composed of tubular drill rod elements, wherein the drill drive is supported in a vertically movable manner along a drilling axis between a lower borehole opening and an upper retracted position, a first storage area on the base frame for storing the individual tubular drill rod elements for assembly of the drill rod, wherein a receiving part for a drill core is in each case held in a releasable manner in the drill rod elements, a second storage area on the base frame for storing the receiving parts with the obtained drill cores as a ground sample, a supply means, with which individual drill rod elements can be supplied from the first storage area to the drilling axis in order to form the drill rod, and a removal means for removing a receiving part with drill core from the drill rod and for depositing in a specific storage place in the second storage area, in accordance with the preamble of claim 1.

The invention further relates to a method for procuring and analyzing ground samples of a bed of a body of water, in which an underwater drilling device with a base frame is lowered into a body of water and placed onto a bed of the body of water, having a drill drive which is supported in a vertically movable manner on the base frame, a drill rod composed of at least one tubular drill rod element is drilled into the bed of the body of water in a first drilling step, wherein a drill core is received in a receiving part in the tubular drill rod element, the receiving part with the drill core is removed by means of a removal means from the drill rod and deposited in a storage place of a second storage area on the base frame, and subsequently at least one further drilling step is carried out, wherein by means of a supply means a second drill rod element with a receiving part for a drill core is supplied to the drill rod and a further drilling of the drill rod is effected with the drill drive, in accordance with the preamble of claim 9.

A generic underwater drilling device and a generic method can be taken, for example, from WO 2012/000077 A1 or from U.S. Pat. No. 7,380,614 B1. In these known underwater core drilling methods a borehole is produced step-by-step according to the length of a drill rod element. At each drilling step the drill core formed in the tubular drill rod is received by a drill core catcher, removed from the drill rod and deposited in a storage area on a base frame of the drilling device. By repeating this core drilling method several times a plurality of drill cores can be procured as ground samples and deposited in the storage area of the drilling device. The drill cores permit a very precise statement on the structure of the bed of a body of water.

In the case of this known prior art, an analysis of the structure of the bed of a body of water renders it necessary for the entire drilling device to be raised from the bed of the body of water and moved out of the body of water onto a supply vessel or a supply platform. There the individual drill cores can be removed, examined in greater detail and analyzed. The procurement and analysis of the ground samples is very time-consuming. Especially when carrying out the method on the high seas a high expenditure of time is also tied up with very high costs, since the hourly or daily rates for supply vessels with the necessary staff are very high. Daily rates for such supply vessels can amount to several 10,000.-EUR to over 100,000.-EUR per day.

From WO 2013/188903 A1 a method for examining a bed of a body of water is known, in which the electrical conductivity and a magnetic property of the ground is detected along a borehole using a sensor means. For this purpose, a sensor is moved along the borehole wall. However, to obtain a reliable measurement two basic method steps are necessary in this case. First of all, the borehole needs to be produced and afterwards the measurement has to be conducted. Moreover, during drilling of the borehole and discharge of the drilled ground material from the borehole there is the fundamental problem that smearing can occur between the individual layers. This makes it difficult to reliably determine the layer structure of the bed of the body of water.

Another method for analyzing a bed of a body of water can be gathered from U.S. Pat. No. 4,043,404 A. In this known method a borehole is produced with a specific drilling tool which has a cylindrical housing. In the cylindrical housing receptacles for receiving ground samples are provided. However, the receiving space for receiving ground samples inside the drilling tool located in the borehole is limited. Furthermore, the taking of ground samples that have a considerably smaller diameter than the drilling diameter proves to be elaborate and requires a particular sampler.

In a land-based drilling method it is known that drill cores are examined directly at the drilling site.

From DE 695 01 539 D2 a method and a device for detecting radioactivity on a drill core can be taken. On this drilling device above ground a sensor means, which can detect radioactive radiation on a drill core, is arranged directly on the drilling device.

The invention is based on the object to provide an underwater drilling device and a method for procuring and analyzing ground samples of a bed of a body of water, with which ground samples can be obtained and analyzed both in a reliable as well as time-efficient and thus cost-efficient manner.

The invention is achieved on the one hand by an underwater drilling device having the features of claim 1 and on the other hand by a method having the features of claim 9. Preferred embodiments of the invention are indicated in the respective dependent claims.

The underwater drilling device according to the invention is characterized in that on the base frame in a surrounding area of the drilling axis at least one sensor means is arranged, which is designed for determining at least one physical and/or chemical property of the drill core, and in that a data processing means is provided, which is designed for storing data determined on the at least one physical and/or chemical property of the drill core and data on the storage place of the drill core in the second storage area.

A basic idea of the invention resides in the fact that, just as in the method known in accordance with the generic prior art, drill cores are obtained with an underwater drilling device during the elaborate core drilling method. Following raising from the bed of a body of water, the drill cores thus obtained can be analyzed in detail and used to create a precise geological profile especially when a plurality of sample drillings is carried out at different locations.

An essential aspect of the invention resides in the fact of not waiting for the drilling to be completed before commencing with the analysis of the drill cores. In fact, first data on the property and especially on the structure of the drill core can be obtained as early as during the drilling process when the drill core is removed on the drill rod. Especially when exploring natural resources this first analysis of specific parameters permits a statement as to whether a continued drilling at a location is still worthwhile or should be discontinued. Hence, a drilling holding no prospect for success can thus be ascertained and terminated at an early stage, which saves time and costs.

Moreover, drill cores that already seem promising or drill cores of particular interest can be determined as early as during the drilling process. Once the underwater drilling device with the drill cores has been raised, the drill cores of particular interest can then be examined and analyzed first. From this, conclusions on the location or nature of a further sample drilling can be drawn more quickly.

A preferred embodiment of the invention resides in the fact that a data transmission unit is provided, with which the determined data can be transmitted to a central facility located at a distance. By means of the data transmission unit the transmission of data can be effected in a wireless or wired manner. This permits an early analysis of drill cores e.g. on the supply vessel or in a remote central facility while the sample drilling is still being carried out.

According to a further development of the underwater drilling device pursuant to the invention an especially efficient implementation of the method is achieved in that the data processing means has an evaluation unit, in which decision criteria are stored and which is configured to make a decision on a continuation or discontinuation of drilling on the basis of the stored decision criteria. As decision criteria in particular minimum or maximum values for specific physical or chemical quantities can be provided, which are of particular importance for a decision on a continuation or discontinuation of drilling. For instance information on the electrical conductivity or on the inductivity behavior of the drill core may indicate the existence or non-existence of specific metallic natural resources. These decision criteria can be defined by test methods carried out in advance or also by way of empirical results of previous drilling operations. The decision criteria mainly depend on the respective type of natural resource selectively being sought after. If, for example, specific characteristic values are not reached at a particular drilling depth, it may be economically reasonable to discontinue further drilling at this examination site and to continue at a different location. A comparison with the measured values of the previous drill core or cores can also be made in the data processing means. In this way, it can be established if one is drawing closer to or further away from the deposit of a particular natural resource, as for example massive sulfide, ores or oil.

As a result of this embodiment according to the invention, it is in this case no longer necessary for the drilling device to be retrieved from the body of water for an analysis of the drill cores. In fact, the underwater drilling device can remain in the body of water and be shifted with the supply vessel to a different location.

Basically, the sensor means can be designed and arranged in any chosen way. According to an advantageous embodiment of the invention provision is made for the at least one sensor means to be annular and arranged in the area above the borehole opening. The borehole opening can be a borehole plug or a different type of arrangement for stabilizing the opening at the borehole. Through an annular arrangement of the sensor means a comprehensive and preferably contact-free detection of the drill core can be implemented immediately at the point of exit from the borehole. The sensor means can be designed such that a determination is effected contact-free even through the wall of the tubular receiving part, for example as a result of interaction with a magnetic or electromagnetic field. For instance an increased or reduced proportion of mineral oil present in a rock can markedly change its electromagnetic resonance behavior and its conductivity.

Basically, a suitable sensor means can be selected according to the intended search for specific natural resources. Provision can also be made for optical sensors or sensors for measuring radioactivity. According to a preferred embodiment of the invention provision is made for the sensor means to be designed for measuring an inductance, electrical conductivity, a capacity and/or further physical or chemical quantities. In particular, different types of sensors can also be provided in an annular housing so that an examination and analysis of different characteristic values can take place simultaneously.

Furthermore, according to an embodiment of the invention it is advantageous for the receiving part to be designed in a tubular manner as a core tube catcher, which has at its upper end a connecting means for the removal means. The core tube catcher can be formed in particular as a thin-walled tube made of metal or plastic, into which, during drilling of the tubular drill rod, an inner residual ground area is, as a drill core, slid into a receiving space of the core tube catcher. Through a suitable locking means or other types of holding means the drill core can be fixed in the tubular receiving part. After a further drilling step has taken place according to the length of a drill rod element, the receiving part with the drill core enclosed therein can be pulled by the removal means out of the drill rod and conveyed to the second storage area, in which case the receiving part with the drill core is deposited in a specific intended storage place of the second storage area. After the deposit the removal means can be released from the receiving part so that a further receiving part with a drill core can be removed once a further drilling step has taken place.

According to a further development of the invention it is advantageous for the removal means to have a winch with a hoist rope, at the free end of which a locking means is arranged which interacts with a connecting means on the receiving part for the drill core. The locking means can be a hook arrangement in particular which engages in a connecting means designed e.g. as an eye on the tubular receiving part. In this manner, a form-closed connection can be established for removing the receiving part with the drill core. However, other connecting methods, such as an electromagnetic connection brought about by an arrangement of suitable electromagnets, are conceivable too.

Another preferred embodiment of the invention resides in the fact that the base frame is connected via a maritime umbilical to a supply vessel. The maritime umbilical can be provided both for the supply of energy, in particular electrical energy and hydraulic fluid, and as a data line for data communication. Moreover, the maritime umbilical can also be designed as a hoist rope, with which, in addition to the supply function, the underwater drilling device can be lowered and raised again.

With regard to the method the object stated at the beginning is achieved in accordance with the invention in that by means of at least one sensor means arranged on the base frame in a surrounding area of the drilling axis at least one physical and/or chemical property of the drill core is determined and in that the data thereby determined are stored in a data processing means together with the data on the storage place of the drill core in the second storage area. The method according to the invention can be carried out, in particular, with the previously described underwater drilling device.

When implementing the method the advantages set out beforehand are achieved.

According to the invention a preferred variant of the method resides in the fact that on the basis of the data determined on the at least one physical and/or chemical property of the drill core a decision is made on a continuation or discontinuation of drilling while the drilling device is still located in the body of water on the bed of the body of water. This decision can preferably be made by the underwater drilling device itself by an evaluation unit disposed in the data processing means or via remote data transmission from a central facility located at a distance, e.g. on the supply vessel or a station on land.

In this way, abortive drillings can be recognized at an early stage and the underwater drilling device can be employed in a time- and cost-efficient manner.

Figure 2:
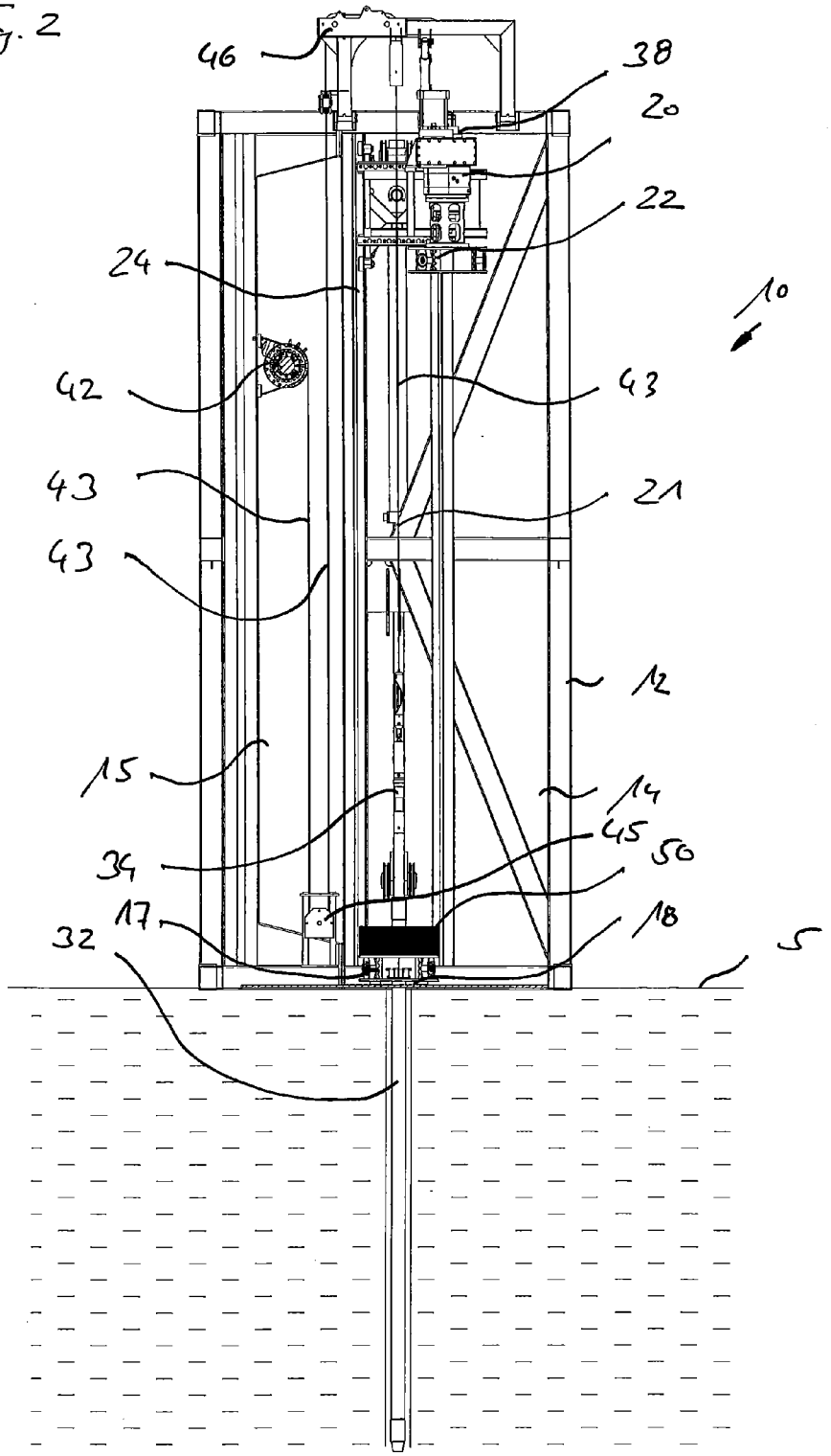
Figure 3:
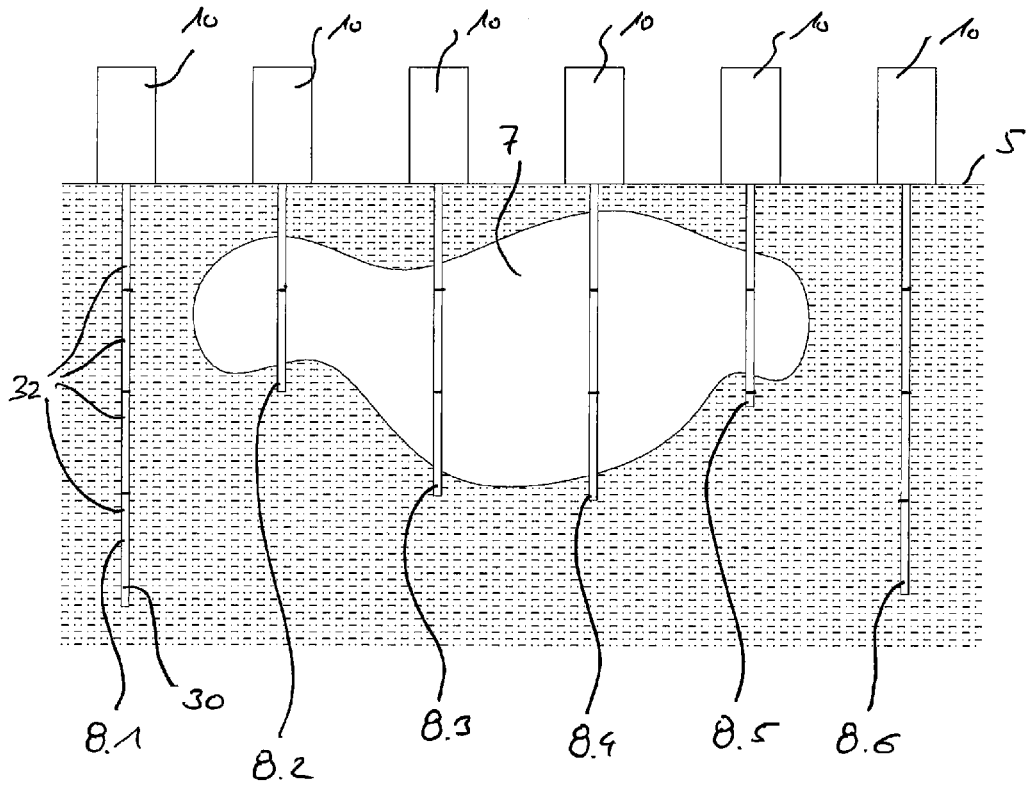

In the following the invention is set out further by way of preferred embodiments illustrated schematically in the accompanying drawings, wherein show:

FIG. 1 a schematic perspective view of an underwater drilling device according to the invention;

FIG. 2 a schematic side view of the underwater drilling device according to FIG. 1; and FIG. 3 a schematic illustration with a plurality of sample drillings.

The structure and function of an underwater drilling device 10 according to the invention are explained in conjunction with FIGS. 1 and 2. The underwater drilling device 10 comprises a box-shaped base frame 12 which is composed of steel girders. In a central area of the base frame 12 a vertically directed drilling guide 24 is provided, along which a drill drive 20 with a tensioning means 22 for tensioning drill rod elements 32 is supported and driven in a vertically movable manner along a drilling axis 21. In addition, the drill drive 20 can be moved away from the drilling axis 21 perpendicularly to the said drilling axis 21 in a horizontal direction along a crossbar 23. The drill drive 20 can serve as a part of a supply means 38 in order to grab drill rod elements 32, which are not depicted and stored in a first storage area 14 of the base frame 12, and guide these into the drilling axis 21. The supply means 38, which is only illustrated schematically, can have further handling means to grab vertically directed, stored drill rod elements 32 and convey these in a known manner to the drilling axis 21.

To form a drill rod 30 a new drill rod element 32 is attached by way of a screw connection to a drill rod element 32 already present. In FIG. 1 only a single drill rod element 32 is shown which has been introduced into the bed of a body of water 5 in a first drilling step. In this initial drill rod element 32 a drill head 31 with ground-removing cutting tools is provided at the lower end. During drilling of the tubular drill rod element 32 a cylindrical drill core is formed by the in-situ ground material. This drill core is received in a tubular receiving part 34 that is arranged in the interior of the drill rod 30.

To remove the tubular receiving part 34 with the drill core arranged and held therein the drill drive 20 is initially moved out of the drilling axis 21. Afterwards, a hoist rope 43 of a removal means 40 is moved by a swivel lever mechanism 41 into the area of the drilling axis 21. At the lower free end of the hoist rope 43 a sleeve-shaped locking means 44 is provided. The hoist rope 43 runs from a winch 42 mounted laterally on the base frame 12 via a lower linkage roller 45 to an upper deflection means 46 of the removal means 40. Through the winch 42 the hoist rope 43 which is deflected several times on the frame is lowered downwards, and in doing so the locking means 44 on the hoist rope 43 engages in a connecting means 36 at the upper end of the sleeve-shaped receiving part 34. As a result, a connection is established, allowing the receiving part 34 with the drill core to be pulled upwards out of the drill rod 30. Subsequently, the sleeve-shaped receiving part 34 with the drill core is conveyed laterally by the removal means 40 to a second storage area 15 on the base frame 12 and deposited there. As is also the case concerning the second storage area 15, the magazine-like storage is not shown in greater detail for the sake of clarity. In the second storage area 15 the sleeve-shaped receiving parts 34 with the drill cores contained therein are stored vertically in holders so that on completion of the drilling operations the drill cores can be conveyed for further examination together with the underwater drilling device 10 to a supply vessel, not illustrated.

For a preliminary examination and analysis of the drill cores an annular sensor means 50 is provided concentrically to the drilling axis 21 directly above the borehole opening 18, on which a tensioning unit 17 for holding the drill rod 30 is arranged. The sensor means 50 is designed with contact-free operating sensors for determining physical and/or chemical properties of the drill core. Furthermore, a data processing means 52 is provided, in which the data determined in each case with regard to a drill core can be stored. At the same time, the data processing means 52 can be used to store the positional data and in particular the storage place, in which the respective drill core is deposited in the second storage area 15. In a subsequent further analysis of the drill cores this makes it possible to selectively fall back on those drill cores which, according to the initial on-site analysis and the data transmitted beforehand by the data processing means 52, are of particular interest for further examination.

After this first drilling step with a securing of a drill core the removal means 40 is moved out of the drilling axis 21 again so that subsequently the drill drive 20 provided with a new drill rod element 32 from the first storage area 14 can be moved into the drilling axis 21 again. The new drill rod element 32 can then be attached to the upper drill rod element 32 of the drill rod 30. Finally, the drill rod 30 can be drilled again by one drilling step by the length of a drill rod element 32 into the bed of a body of water 5. In this process, a new drill core is formed which can be removed from the drill rod 30 and deposited again in the second storage area 15 in line with the previously described method. If desired, further drilling steps can then take place accordingly.

In FIG. 3 a schematic illustration is given of determining a natural resource deposit 7 in a bed of a body of water 5 by means of an underwater drilling device 10 according to the invention and a method according to the invention.

To produce a first drilling 8.1 the underwater drilling device 10 is initially placed onto the bed of a body of water 5. Subsequently, a step-by-step drilling along with procurement and examination of the drill cores is carried out, as has been set out beforehand in conjunction with FIGS. 1 and 2. During the first drilling 8.1 no data concerning a natural resource deposit 7 were established by the underwater drilling device 10 according to the invention in the direct on-site analysis of the obtained drill cores. Accordingly, the first drilling 8.1 has been carried out up to the maximum achievable drilling depth which is illustrated by the drill rod 30 having four drill rod elements 32 in the present case.

After dismantling of the drill rod 30 the underwater drilling device 10 can be shifted to a second position in order to carry out a second drilling 8.2. In the illustrated embodiment, a natural resource deposit 7 is established by the sensor means 50 as early as after the first drilling step. Following the second drilling step during the production of the second drilling 8.2 the in-situ examination of the drill core shows that in this drilling area the natural resource deposit 7 has again come to a halt in this depth position. Since this can be established immediately by an evaluation unit, continuation of the second drilling 8.2 can be brought to an end. The underwater drilling device 10 can then be shifted again to carry out further drillings 8.3, 8.4, 8.5 and 8.6.

The embodiment according to FIG. 3 clearly shows that a direct analysis of the drill cores by the underwater drilling device 10 enables an early termination of drillings e.g. as on leaving an established natural resource deposit 7, as has been the case with the drillings 8.2, 8.3, 8.4 and 8.5. All in all, a time- and therefore cost-efficient method for establishing submarine natural resource deposits 7 can thus be implemented.

The invention claimed is:

1. An underwater drilling device for procuring and analyzing ground samples of a bed of a body of water, having a base frame which is designed for lowering into the body of water and for placing onto the bed of the body of water, a drill drive on the base frame for rotationally driving a drill rod which is composed of tubular drill rod elements, wherein the drill drive is supported in a vertically movable manner along a drilling axis between a lower borehole opening and an upper retracted position, a storage area on the base frame for storing the individual tubular drill rod elements for assembly of the drill rod, wherein a receiving part for a drill core is in each case held in a releasable manner in the drill rod elements, and for storing each receiving part with the obtained drill core as a ground sample, a supply device on the base frame, with which individual drill rod elements can be supplied from the storage area to the drilling axis in order to form the drill rod, and a removal device on the base frame for removing each receiving part with the drill core from the drill rod and for depositing in a specific storage place in the storage area, wherein at least one sensor device is arranged on the base frame, which is designed for determining at least one physical and/or chemical property of the drill core, the at least one sensor device has an annular design, the at least one sensor device is provided in an annular housing, the at least one sensor device is coaxially arranged with the borehole opening, a data processing device is provided on the base frame, which is designed for storing data determined on the at least one physical and/or chemical property of the drill core and data on the storage place of the drill core in the storage area, and the determination of the at least one physical and/or chemical property is effected contact-free through a wall of each receiving part, whereby each receiving part passes through an inner opening of the annular sensor during retrieval of the ground sample.

2. The underwater drilling device according to claim 1, wherein a data transmission unit is provided, with which the determined data can be transmitted to a central facility located at a distance.

3. The underwater drilling device according to claim 1, wherein the data processing device has an evaluation unit, in which decision criteria are stored and which is configured to make a decision on a continuation or discontinuation of drilling on the basis of the stored decision criteria.

4. The underwater drilling device according to claim 1, wherein the at least one sensor device is arranged in the area above the borehole opening.

5. The underwater drilling device according to claim 1, wherein the sensor device is designed for measuring an inductance, electrical conductivity, a capacity and/or further physical or chemical quantities.

6. The underwater drilling device according to claim 1, wherein each receiving part is designed in a tubular manner as a core tube catcher, which has at an upper end a connecting device for the removal device.

7. The underwater drilling device according to claim 1, wherein the removal device has a winch with a hoist rope, at a free end of which a locking device is arranged which interacts with a connecting device on each receiving part for the drill core.

8. The underwater drilling device according to claim 1, wherein the base frame is connected via a maritime umbilical to a supply vessel.

9. A method for procuring and analyzing the ground samples of the bed of the body of water with the underwater drilling device according to claim 1, in which the underwater drilling device with the base frame is lowered into the body of water and placed onto the bed of the body of water, having the drill drive which is supported in a vertically movable manner on the base frame, the drill rod composed of at least one tubular drill rod element of the tubular drill rod elements is drilled into the bed of the body of water in a first drilling step, wherein a drill core is formed and received in a receiving part in the tubular drill rod element, the receiving part with the drill core is removed by means of a removal device from the drill rod and deposited in a storage place of the storage area on the base frame, and subsequently at least one further drilling step is carried out, wherein by means of a supply device a further drill rod element with a receiving part for a drill core is supplied from the storage area to the drill rod and a further drilling of the drill rod is effected with the drill drive, wherein by means of at least one sensor device at least one physical and/or chemical property of the drill core is determined, and the data thereby determined are stored in a data processing device together with the data on the storage place of the drill core in the storage area.

10. The method according to claim 9, wherein on the basis of the data determined on the at least one physical and/or chemical property of the drill core a decision is made on a continuation or discontinuation of drilling while the underwater drilling device is still located in the body of water on the bed of the body of water.

* * * * *